US009233735B2

(12) United States Patent
Ramey et al.

(10) Patent No.: US 9,233,735 B2
(45) Date of Patent: Jan. 12, 2016

(54) FLOATING DOCK MOVER

(71) Applicants: Lester L. Ramey, Wiley, GA (US); Richard H Dawkins, Toccoa, GA (US)

(72) Inventors: Lester L. Ramey, Wiley, GA (US); Richard H Dawkins, Toccoa, GA (US)

( * ) Notice: Subject to any disclaimer, the term of this patent is extended or adjusted under 35 U.S.C. 154(b) by 33 days.

(21) Appl. No.: 14/066,640

(22) Filed: Oct. 29, 2013

(65) Prior Publication Data

US 2015/0114276 A1 Apr. 30, 2015

Related U.S. Application Data

(63) Continuation of application No. 13/374,466, filed on Dec. 29, 2011, now Pat. No. 8,596,211.

(51) Int. Cl.

| | |
|---|---|
| ***B60P 3/10*** | (2006.01) |
| ***B63B 21/16*** | (2006.01) |
| ***B63B 21/26*** | (2006.01) |
| ***B63B 27/14*** | (2006.01) |
| ***B63B 35/00*** | (2006.01) |
| ***E01D 15/24*** | (2006.01) |
| *B63B 35/34* | (2006.01) |
| *B63H 19/08* | (2006.01) |

(52) U.S. Cl.

CPC ..... *B63B 21/16* (2013.01); *B63B 21/26* (2013.01); *B63B 27/14* (2013.01); *B63B 27/143* (2013.01); *B63B 35/00* (2013.01); *E01D 15/24* (2013.01); *B63B 35/34* (2013.01); *B63H 19/08* (2013.01)

(58) Field of Classification Search

CPC ..... B60P 3/10
USPC ..... 114/344
See application file for complete search history.

(56) References Cited

U.S. PATENT DOCUMENTS

| | | | | |
|---|---|---|---|---|
| 3,050,947 | A * | 8/1962 | Burton | E02B 3/064 182/101 |
| 3,088,287 | A * | 5/1963 | Berry | B63B 35/44 114/230.27 |
| 5,282,435 | A * | 2/1994 | Chapman | E02B 3/064 114/263 |
| 5,655,850 | A * | 8/1997 | Holmgren | B63C 3/06 114/48 |
| 6,182,597 | B1 * | 2/2001 | Maxwell | B63C 3/08 114/344 |
| 6,295,944 | B1 * | 10/2001 | Lovett | E02B 3/064 114/230.23 |
| 8,596,211 | B2 * | 12/2013 | Ramey | B63B 21/16 114/344 |
| 8,651,508 | B2 * | 2/2014 | Woodhouse | E02C 3/00 114/344 |

* cited by examiner

*Primary Examiner* — Lars A Olson
*Assistant Examiner* — Jovon Hayes
(74) *Attorney, Agent, or Firm* — Coulter Henry, Jr.; IPLS, LLC

(57) ABSTRACT

A floating dock mover that utilizes electrically powered devices to aid in relocating a floating dock whenever water levels change in a lake or reservoir. Electrical powered winching mechanisms are used to adjust cables lengths to maintain a position, or aid to obtain a new position of the dock in relation to the shoreline. Additionally, a motorized speed reducer is used to turn the wheels on the dock walkway, which moves the walkway and dock away from, or toward the shore. By electrically powering winch cable lengths, plus electrically powering the walkway wheels, the dock can be relocated horizontally and vertically and maintain a relative desired position in relation to a moving shoreline. An additional electrically motorized unit is used to operate an anchor which aids in maintaining a dock in a desired position.

8 Claims, 10 Drawing Sheets

FLOATING DOCK MOVER

CROSS REFERENCE TO RELATED APPLICATIONS

This application is a continuation of U.S. patent application Ser. No. 13/374,466, filed Dec. 29, 2011, now U.S. Pat. No. 8,596,211, which claims benefit of U.S. Provisional Application No. 61/461,303, filed Jan. 18, 2011 both of which are incorporated herein by reference.

FIELD OF INVENTION

This invention relates to a new and useful method to relocate a floating dock in relation to a shoreline that moves due to the rise and fall of reservoir and lake water levels.

BACKGROUND OF THE INVENTION

It is a common necessity of floating dock owners, and property caretakers of lake front property to periodically relocate a dock in relation to the shoreline. On many lakes and reservoirs in the United States water level changes frequently. With water level changes, the shoreline changes, thereby requiring relocation of the dock. If the dock isn't relocated, it can become inaccessible and therefore unusable.

When water level decreases, the shoreline moves inward toward the main body of water. The dock can become beached if it's not relocated accordingly inward toward the body of water. When water level rises, the shoreline changes toward the beach. The dock will need to be relocated toward the beach or it can become isolated. When it becomes isolated, there is no access to the dock without going through water.

Thus, it is desirable to maintain the floating dock at a relative fixed distance from the moving shoreline so the end of the dock walkway is supported by, and accessed by, dry land and the entirety of dock be in water deep enough to allow boats and other recreational vehicles easy access to the main body of water. This requires dock movement to be both horizontally and vertically to changes in the water level.

Floating docks are typically held in place in relation to a shoreline by means of cables and shore anchor points. Typically, there are two anchor cable assemblies, one on each dock corner closest to the shore. The shore anchor points are secured above the high water level. Typically, hand operated winches are attached to the dock and used to control the length of anchor cables, thereby controlling the distance from the shore.

This invention provides an easy to operate and useful means of relocating a dock. The system comprises of an assembly of winches, cables, guide mechanisms, an electrical power source, an electrical box, and a control box with switches.

Throughout this patent, the referenced 'dock assembly' will refer to a novel dock, walkway, walkway wheels with axle, and a walkway ramp. The dock assembly may comprise of a boat dock and include a single or plurality of boats and other recreation equipment.

There are prior systems that aid in relocating said dock assembly. But they are found to be time consuming and difficult to operate. It is common among docks that require relocating to comprise of two hand crank manually powered cable winches. These manual winches attached to the dock on the two corners closest to the shoreline. The winch cables run from the manual winches to anchor points on the beach. This system requires a lot of manual effort to get the dock moving toward shore and to keep it moving in a desired perpendicular path to shoreline.

To relocate said dock assembly away from shore, manually powered winches securing the dock to the shore are released, thereby causing the cables securing to the shore to let out. Then, by manually pushing the walkway wheels, or pushing the dock assembly toward the body of water, the dock assembly moves away from the shoreline. This manual process of moving the dock assembly is difficult and typically requires a plurality of people. Windy conditions can make it near impossible to move it without additional manual help.

U.S. Pat. No. 3,050,947 (1962) to Burton involves a stationary shore supported stairway 10, an articulated walkway 12, and boat dock platform 14 anchored at the top shoreline and to the bottom of the body of water. Because it utilizes a permanent anchor to the bottom of the body of water, the stairway would not be permitted on many lakes and reservoirs. Furthermore, this patent would not be practical if the beach angle and angle of dirt just below the shoreline is a low angle. A 10 feet water level drop may require a guide mechanism and stairway over 100 feet in length. Furthermore, the bottom engaging anchor 152, free weight 148, and chain 144 are safety concerns to swimmers and recreational vehicles.

U.S. Pat. No. 3,088,287 to Berry (1963) frame 10 and base 13 are not permitted on many bodies of water because no portion of the dock are allowed to contact the ground surface of the beach or below the body of water. In addition, the guide rails are not practical for lakes or bodies of water that have a low angle of beach because they would have to be long in length. This patent will work for a steep beach angle, but not for a gradual slope of beach and shoreline. There are many dock locations where the water level may drop 10 feet and the shoreline moves inward toward the main body of water 100 feet. To work, this patent stairway 16 would need to be over 100 feet in length to compensate for a 10 feet drop in water level. This would not be practical.

U.S. Pat. No. 3,276,211 to Drake (1966) does not allow for horizontal relocation of the Dock.

U.S. Pat. No. 3,683,838 to Godbersen (1972) utilizes anchor points secured to the bottom land beneath the body of water by anchor 58. This would not be permitted on many lakes and reservoirs that require only floating docks. Chains 13 is a potential safety hazards for boaters, swimmers, and other water recreation.

U.S. Pat. No. 5,238,324 to Dettling, Jr. (1993) provides a portable boat dock and boat lift that can be used to relocate the wheeled boat dock and lift to another shore accessible area of the body of water. It has a ball receiver end 66 for connecting to a towing vehicle. It is not a dock mover that is easily moved in and outward from the shoreline. The anchor system is manually positioned 59 and 60 stake members and therefore not practical for relocating a dock due to changing water levels. Additionally, it is not tethered to the shore with cables or the like and in windy conditions can easily get turned and off perpendicular with the shoreline.

Ratchet 26 in U.S. Pat. No. 5,282,435 to Chapman (1994) is made to touch and drag the surface along the bottom of the body of water. This will disturb the land below the water and eventually wear a pathway groove in the bottom surface 30. Lower anchor 22 must be secured to the bottom, which is not be permitted on most lakes and reservoirs requiring floating docks.

U.S. Pat. No. 6,295,944 to Lovett (2001) utilizes a constant force spring mechanism to provide constant force. This would be impractical if the traveling distance was more than a few feet in either direction, or a steep direction. Slippage of the tires in mud or slick bottom would release the spring pressure and the boat dock many not move. Upon slippage, hand crank 20 is used to input additional spring tension. Manually inputting additional spring pressure utilizing hand crank 20 would be difficult to provide enough spring force to allow the boat dock to move up a steep beach.

Accordingly, several objects and advantages of the embodiment of my floating dock mover are:

a) To provide a vast improvement over prior art in design, construction, and ease of use to relocate a floating dock assembly both vertically and horizontally when lake or reservoir water level increases and decreases;

b) A method to electrically power an anchor mechanism for the dock assembly when a desired new location is achieved;

c) To provide an electrically powered method to raise and lower a walkway ramp attached to the end of a dock walkway.

Additional objects and advantages will become apparent from a consideration of the ensuing summary, description, and drawings.

SUMMARY OF THE INVENTION

The present invention relates to a combination of devices for relocating a floating dock whenever water level increases or decreases in a lake or reservoir. Changes in water level causes the shoreline to change accordingly. To continue to be usable, the floating dock must maintain a relative constant distance from the shoreline. When water level decreases, the shoreline moves inward toward the main body of water and the floating dock should be moved in or it will become beached. When water level increases, the shoreline moves away from the main body of water and the floating dock should be moved out from the body of water toward the shoreline or it will become isolated by water.

It is the goal of the present invention to maintain a floating dock at a more or less constant position and orientation relative to a moving shoreline. This can easily be done by the embodiment of my floating dock mover by activating electrical switches that power electrical motors and winches that make adjustments to shore anchoring cable lengths which controls the position and orientation of the dock. Additional electrical switches control a motorized anchor mechanism and another switch controls a motor mechanism that powers the wheels on the dock walkway to rotate, thereby moving the dock assembly in relation to the shoreline.

DESCRIPTION OF DRAWINGS

A preferred form of the embodiment of my floating dock mover is illustrated in the accompanying drawings in which.

DESCRIPTION OF PREFERRED EMBODIMENT OF THE INVENTION

Figure 1:
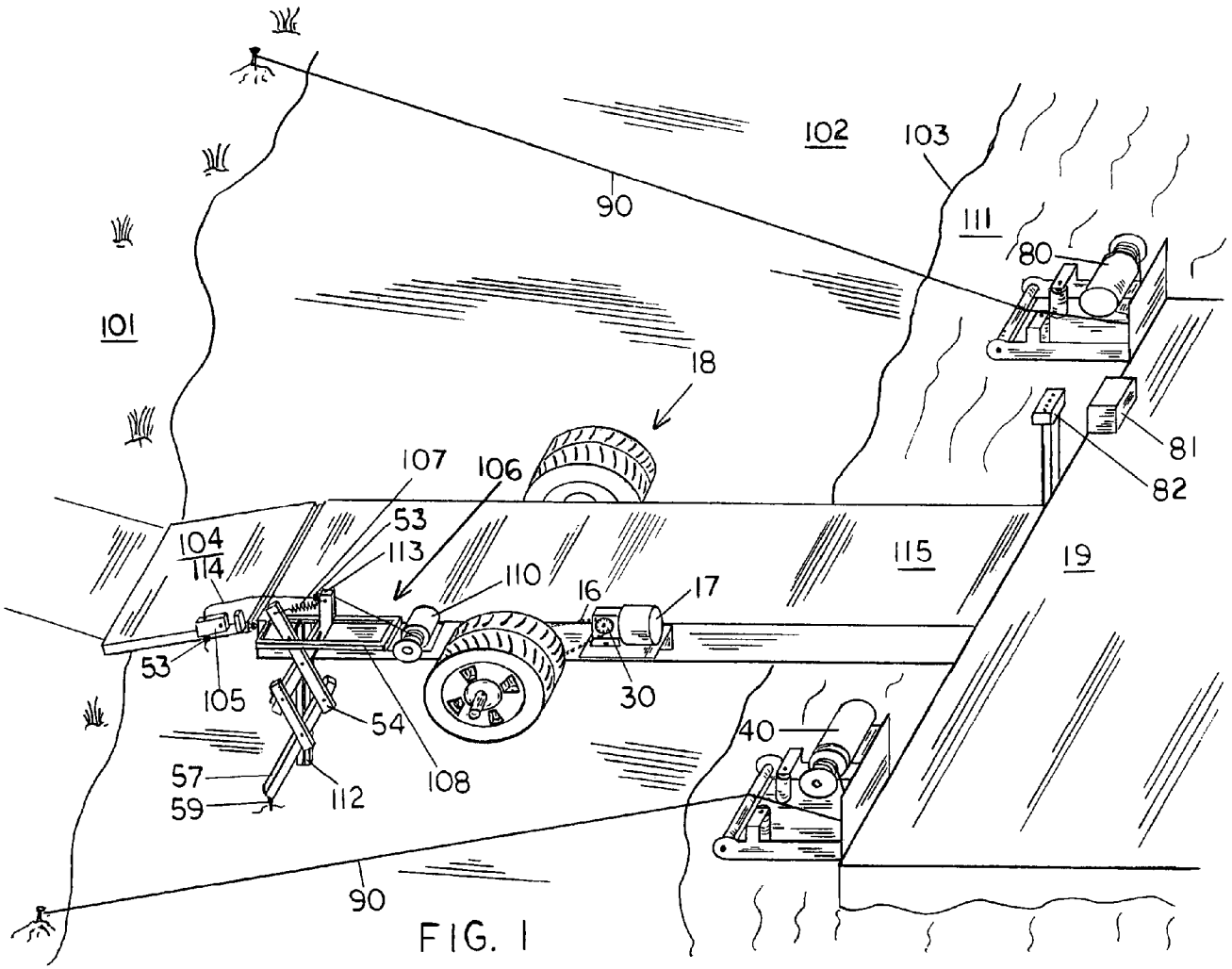
FIG. 1 shows a pictorial view of a floating dock mover where the dock assembly is in need of being relocated toward the main body of water. The view shows a walkway ramp, a walkway, a dock, an anchor assembly, and a powered live axle wheel system. Also shown are mooring winch mechanisms on the two closest dock corners.

FIG. 1 shows an overall perspective view of the floating dock mover of the first embodiment. The view of the first embodiment shows shore embankment 101, beach area 102, water shoreline 103, a lake or reservoir body of water 111. A floating dock 19 has an attached walkway 115, and a walkway ramp 104. Attached to walkway ramp 104 is a pivot arm 105. FIG. 1 shows anchor assembly 106 is comprised of an electrical powered anchor/ramp winch 110, which is attached to anchor frame 108. Lower anchor arm 57 has a rod 59 secured to the lower end. Vertical anchor guide 112 also shown on FIG. 8 maintains vertical alignment of anchor assembly 106. Winch cable 114 connects through primary winch anchor arm 113 and pivot arm 105. Winch cable 114 has a plurality of cable stops 53 that secures the limit position of winch cable 114 when moved through primary winch anchor arm 113 and pivot arm 105. A spring 107 is attached to primary winch anchor arm 113 and anchor cross arm 54.

Live Axle wheel assembly 18 comprises of a motorized powered speed reducer 17 and a clutch sprocket 30 and a chain 16. Clutch sprocket 30 with chain 16 will turn a sprocket 36, also shown in FIG. 2A and FIG. 2B. When powered sprocket 30 will power sprocket 36 in one direction and sprocket 30 will slip internally if powered in the opposite direction.

Figure 10:
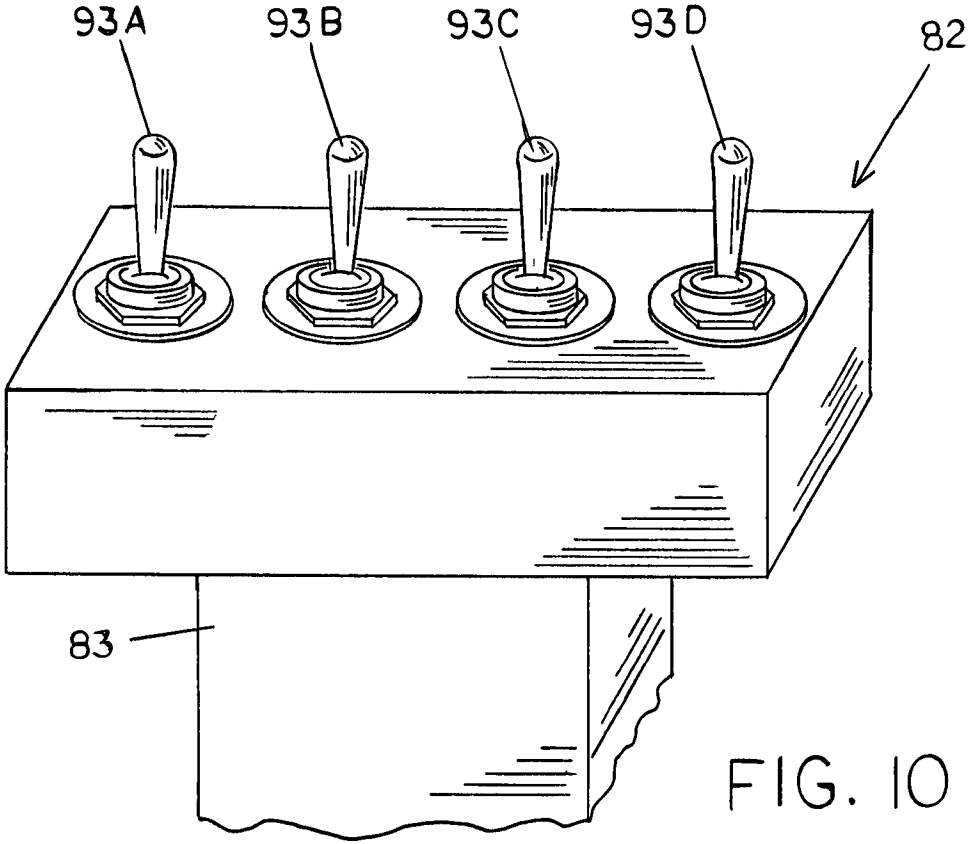
FIG. 10 shows a perspective view of a preferred control center.

FIG. 1 shows a floating dock 19 with a left mooring winch mechanism 40 and a right mooring winch mechanism 80 with a plurality of cables 90 that a secure dock 19 in a location to a shore embankment 101. An operator control center 82 (electrical circuit not shown) includes a plurality of switches 93A, 93B, 93C, and 93D as shown in FIG. 10 that operates FIG. 1 a anchor/ramp winch 110, a motorized speed reducer 17, and a mooring winch mechanisms 40 and 80. An electrical control enclosure 81 (electrical circuit not shown) encompasses the electrical components and electrical control circuitry. Each of said switches 93A, 93B, 93C, and 93D have a normally open center position, a back position and a forward position.

Figure 2A:
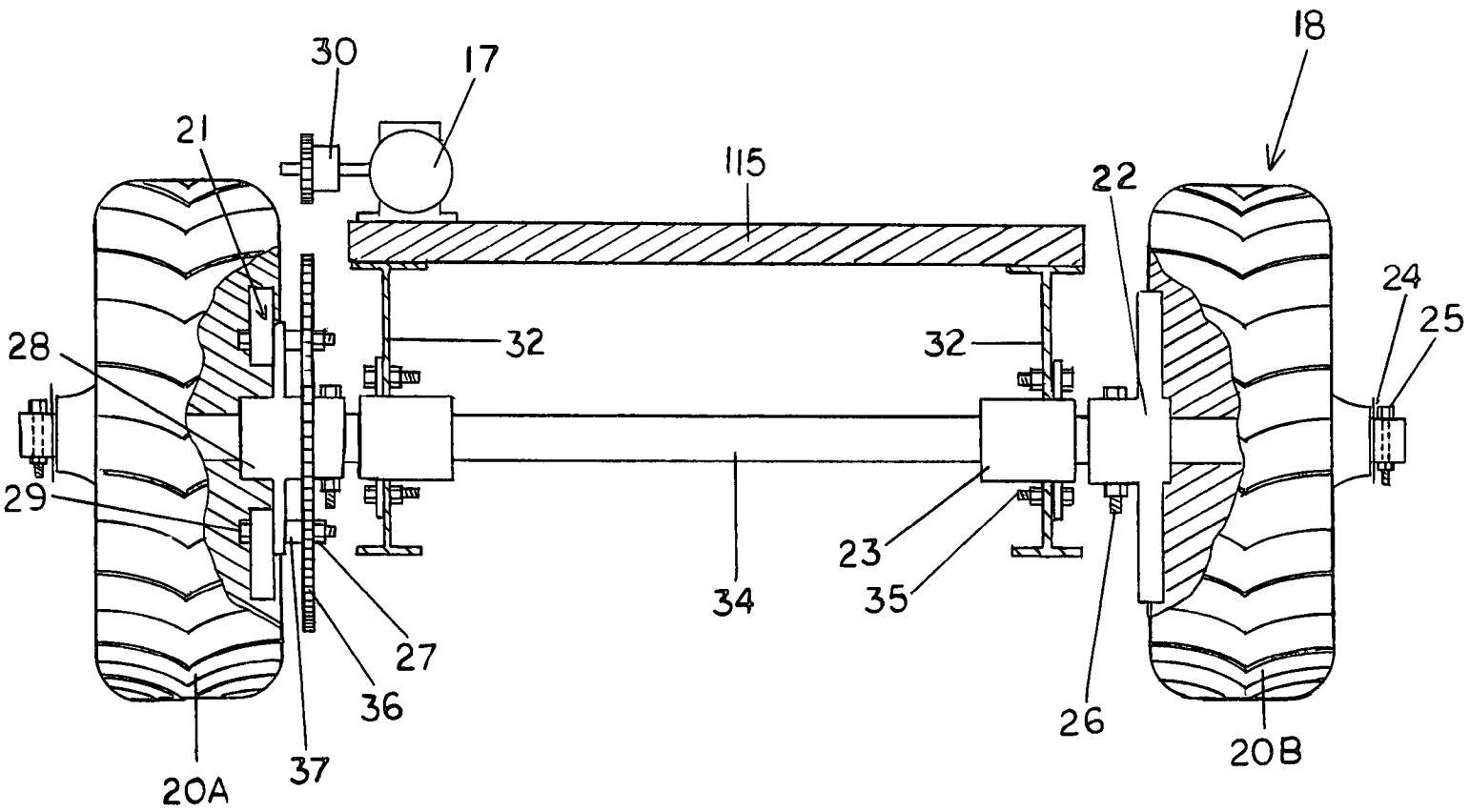
FIG. 2A shows a partial cross sectional perspective view of the preferred live axle assembly installed on a walkway. It is shown without the roller chain connecting the small sprocket to the large sprocket.

FIG. 2A shows a partial sectional view of a live axle wheel assembly 18 mounted to a walkway 115. An axle 34 is secured to a plurality of walkway frame beams 32 by a plurality of axle bushings 23. Axle bushings 23 are secured to frame beams 32 by a plurality of bolt and nut assembly 35. A master drive hub assembly 21 slides into a recessed area of a wheel 20A. Wheel 20A has a recessed area that accepts the master drive hub assembly 21 and engages master drive hub assembly 21 with wheel 20A so when master drive hub assembly 21 rotates, so must wheel 20A. Master drive hub assembly 21 includes a master drive hub 28, attached to a sprocket 36 by a bolt 29 and a nut 27. A plurality of spacers 37 make a predetermined space between a master drive hub 28 and sprocket 36. A plurality of inner axle bolt and nut 26 secure master drive hub assembly 21 and a slave drive hub 22 to axle 34. Slave drive hub 22 is positioned in a recessed area of a wheel 20B. Wheel 20B has a recessed area that accepts slave drive hub 22 and engages slave drive hub 22 with wheel 20B. Wheels 20A and 20B are secured in position on axle 34 by a plurality of washers 24 a plurality of outer axle bolt and nuts 25.

Not shown in this drawing is a chain 16, which connects from clutch sprocket 30 to sprocket 36. Sprocket 36 is secured to master drive hub assembly 21 which in turn is engaged with wheel 20A. Inner axle bolt and nut 26 in the master drive hub assembly 21 engages master drive hub assembly 21 to axle 34. Inner axle bolt and nut 26 in a slave drive hub 22 engages a hub 22 to axle 34. A plurality of washer 24 and a plurality of outer axle bolt and nut 25 are used to secure the proper location of wheels 20A and 20B on axle 34.

Motorized speed reducer 17 drives clutch sprocket 30 and therefore chain 16. Chain 16 connects sprocket 36 to clutch sprocket 30.

Master drive hub assembly 21 is comprised of the master drive hub 28, sprocket 36, a plurality of spacer 37, and plurality of bolt 29 and nut 27.

Figure 2B:
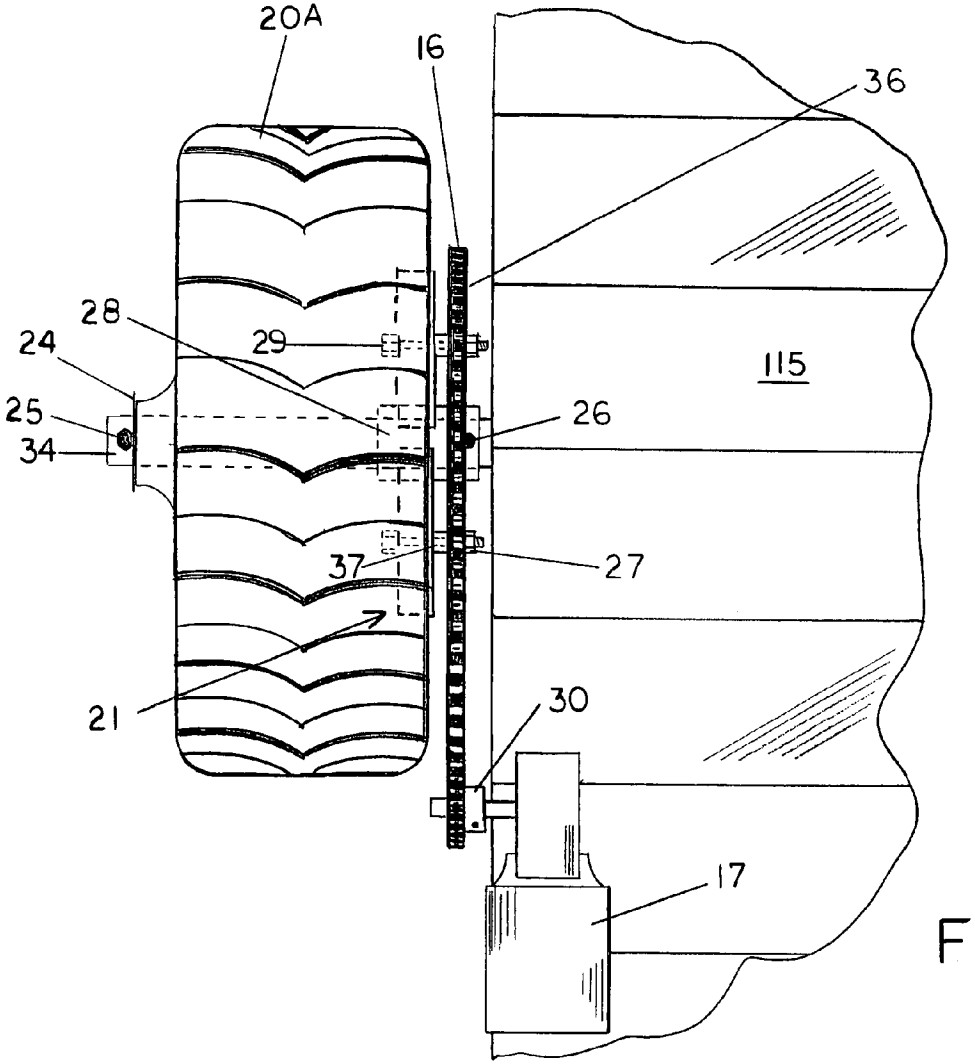
FIG. 2B shows a top partial sectional perspective view of the powered live axle drive mechanism with the roller chain connecting the small sprocket to the large sprocket.

FIG. 2B shows a top view of section of walkway 115 where motorized speed reducer 17 is connected to clutch sprocket 30, which connects to chain 16, which connects to large sprocket 36. Sprocket 36 is secured to master drive hub assembly 28 using bolts 29, spacers 37, and nuts 27. Master drive hub assembly 21 is secured to axle 34 by inner axle bolt and nut 26. Also shown is wheel 20A engaged with master drive hub assembly 21 and held in place on axle 34 by outer axle bolt and nut 25 and washer 24.

Figure 3:
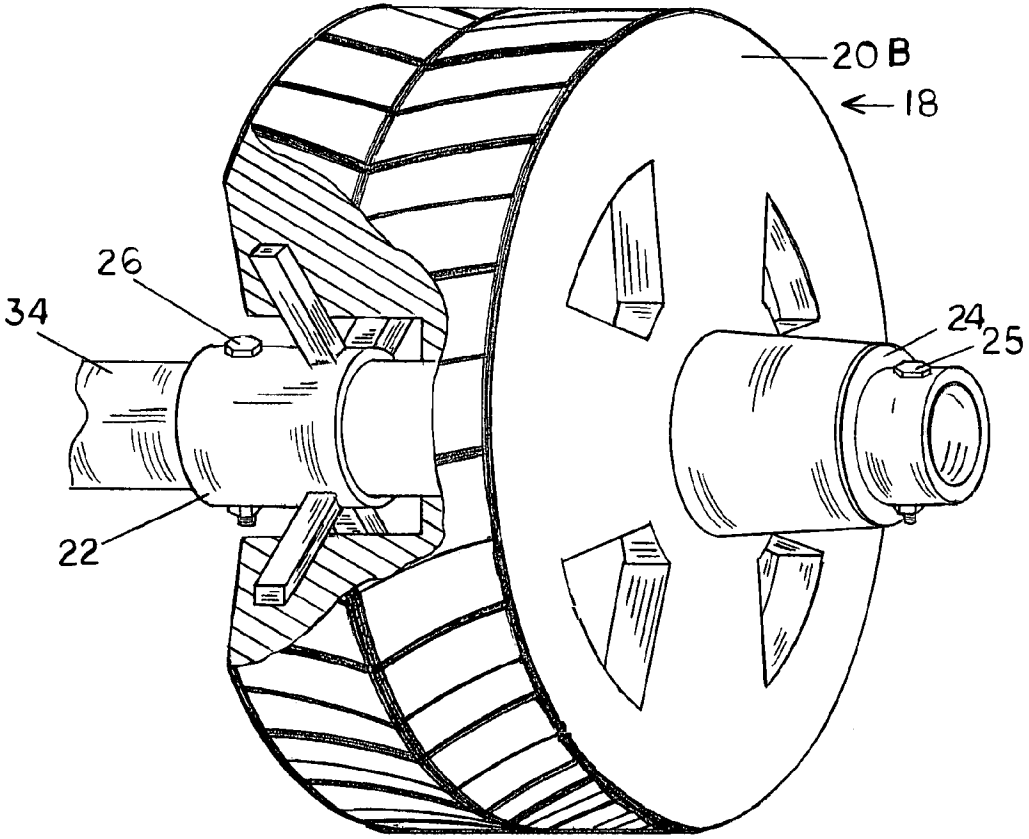
FIG. 3 shows a partial sectional perspective view of a slave drive hub slid into a recessed area of a wheel.

FIG. 3 shows a partial sectional perspective view of slave drive hub 22 engaged with wheel 20B. This view is part of a live axle wheel assembly 18. Washer 24 and outer nut and bolt 25 are used to secure the location of wheel 20B on axle 34. Slave drive hub is secured to axle 34 by inner axle bolt and nut 26.

Figure 4B:
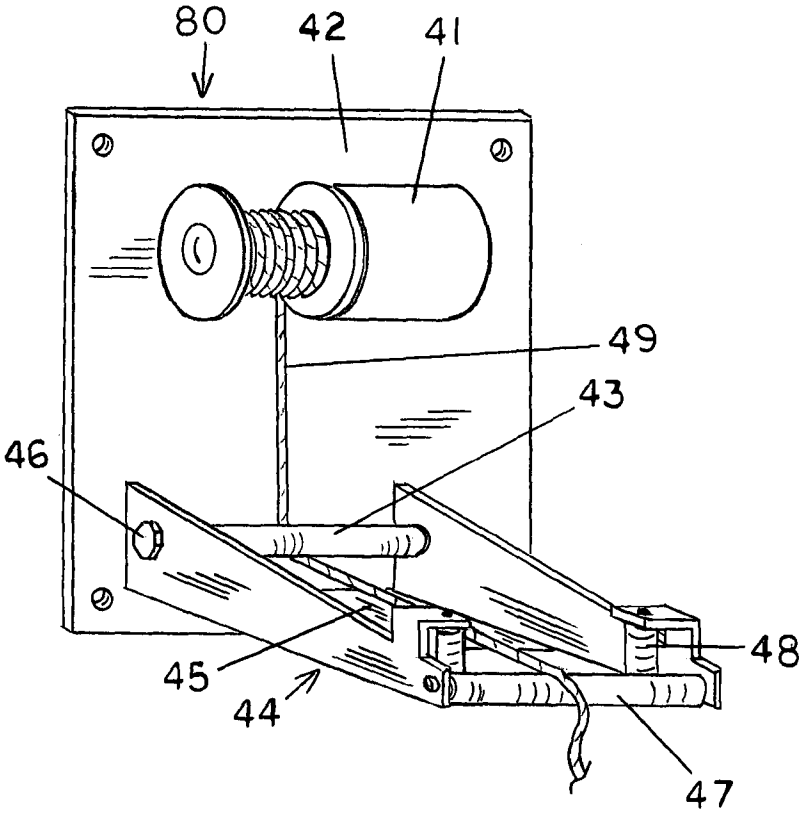
FIG. 4A and FIG. 4B show perspective views of the preferred mooring winch mechanisms.
Figure 4A:
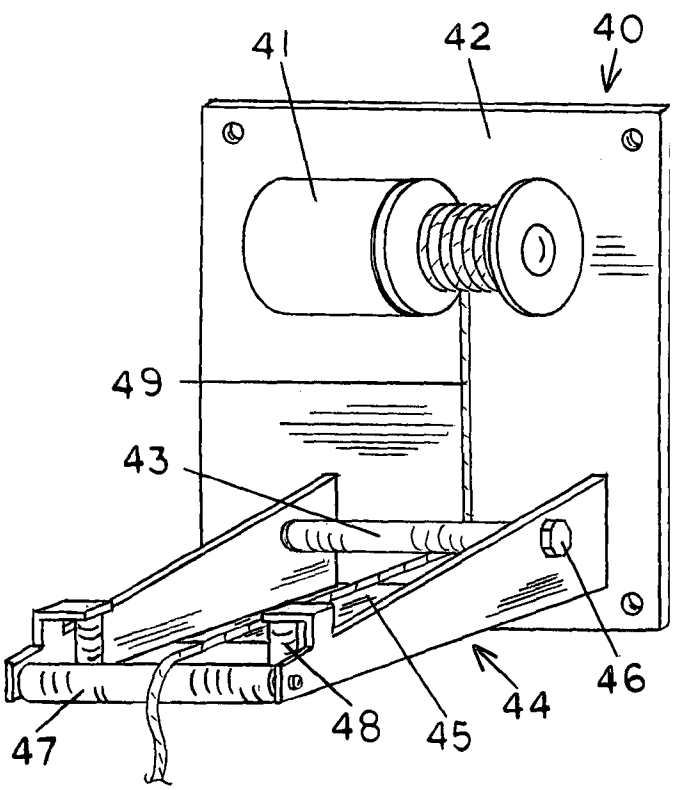

FIG. 4A and FIG. 4B shows perspective views of a left mooring winch mechanisms 40 and a right mooring mechanism 80. The mooring winch mechanisms comprise of a back plate 42 with a powered winch 41 and a cable 49. They also include a cable feed assembly 44, which comprises of a roller 43 held with a bolt 46. Said feed assembly 44 has a bottom 45. Cable 49 is guided and let out through a feed rollers 47 and 48.

Figure 5A:
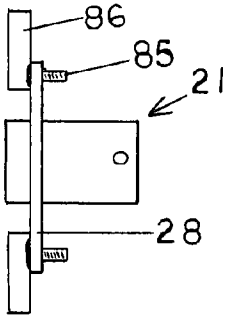
FIG. 5A and FIG. 5B show a side view and a perspective view of a preferred master drive hub assembly.
Figure 5B:
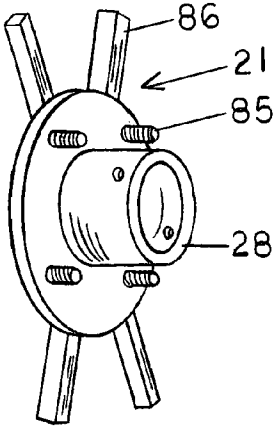

FIG. 5A shows a side view and FIG. 5B shows a perspective view of a master drive hub assembly 21. A plurality of an extension 86 are secured to a master drive hub 28. Said hub 28 has a plurality of bolts 85.

Figure 6A:
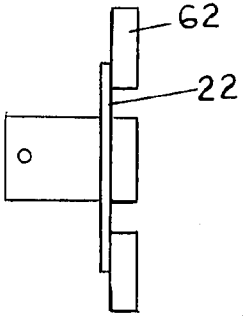
FIG. 6A and FIG. 6B show a side view and a perspective view of a preferred slave drive hub.
Figure 6B:
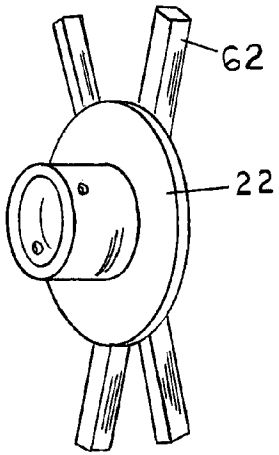

FIG. 6A shows a side view and FIG. 6B shows a perspective view of a slave drive hub 22. A plurality of extensions 62 are secured to slave hub 22.

Figure 7A:
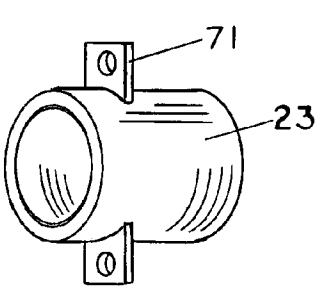
FIG. 7A shows a perspective view of a preferred axle bushing.
Figure 7B:
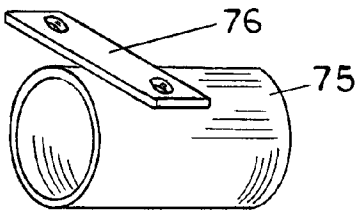
FIG. 7B shows a perspective view of an alternate-embodiment axle bushing.

FIG. 7A shows a perspective view of a preferred embodiment of an axle bushing 23. Axle bushing 23 has a plurality of flanges 71 with holes for mounting. FIG. 7B shows a perspective view of an alternate embodiment axle bushing 75 with a top rail 76 for mounting. Top rail 76 has holes for mounting.

Figure 8:
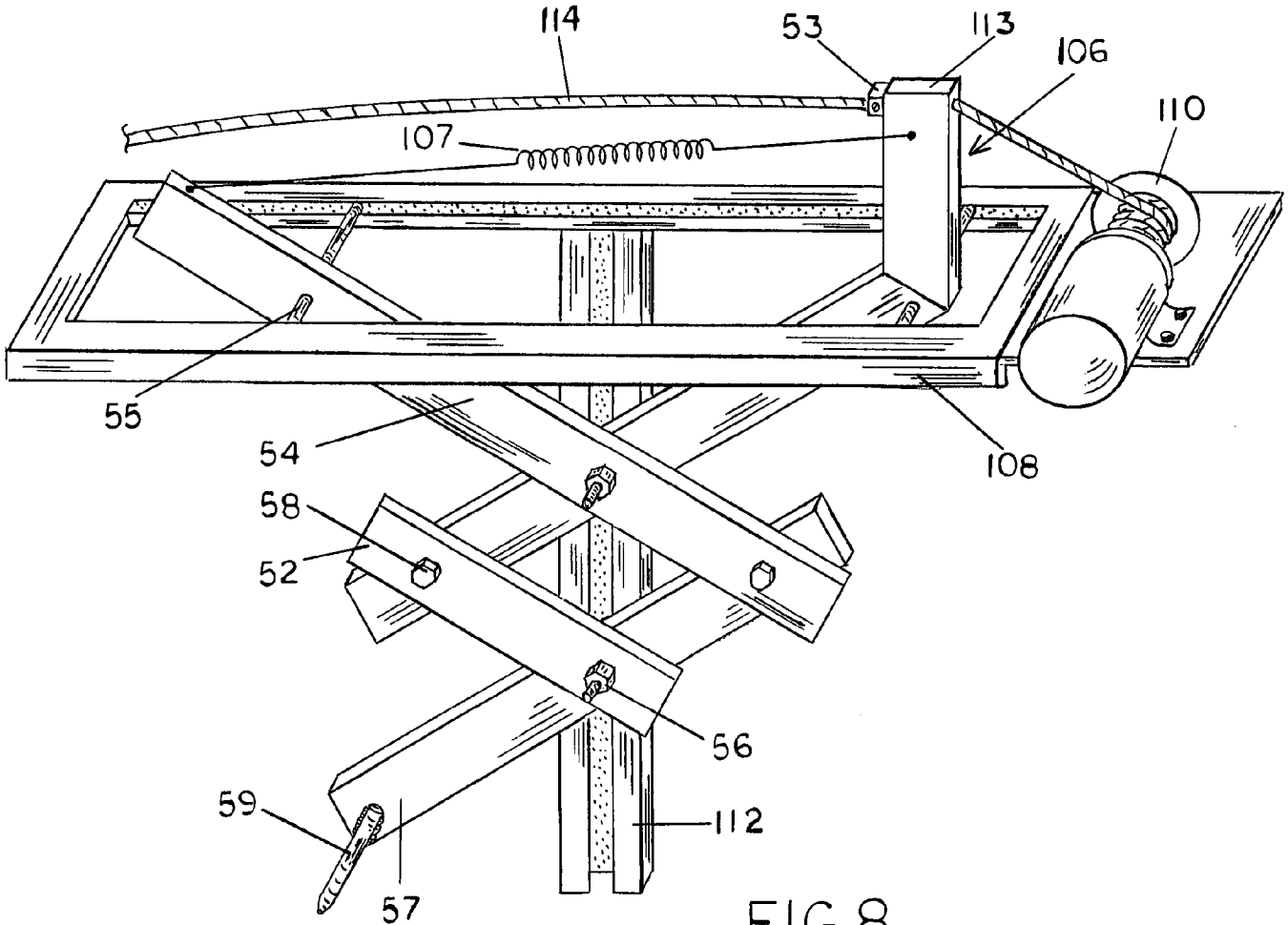
FIG. 8 shows a perspective view of a preferred walkway anchor mechanism.

FIG. 8 shows a perspective view of a walkway anchor assembly 106. Anchor assembly 106 is comprised of a channel for a plurality of anchor slide pins 55 to slide. Anchor slide pins 55 are secured to an anchor cross arm 54 and a primary winch anchor arm 113. Anchor cross arm 54 and primary winch anchor arm 113 are connected to an anchor arm 52 and a lower anchor arm 57 by a plurality of bolt and nut 58. Lower anchor arm 57 has and rod 59 attached to the lower part.

A spring 107 is attached to anchor cross arm 54 and primary winch anchor arm 113. An anchor/ramp winch 110 is mounted to a flat surface on an anchor frame 108. A winch cable 114 attaches through primary winch anchor arm 113 with a cable stop 53 on winch cable 114. Spring 107 maintains a constant contraction pressure when anchor/ramp winch 110 is let off and winch cable 114 loosened. Lower anchor arm 57 will retract upon anchor/ramp winch 110 taking up cable. A vertical anchor guide 112 has a slotted channel with the head of plurality guide bolt and nut 56 that slide within vertical anchor guide 112. A plurality of guide bolt and nut 56 maintains vertical alignment during extension and retraction of anchor assembly 106.

Figure 9:
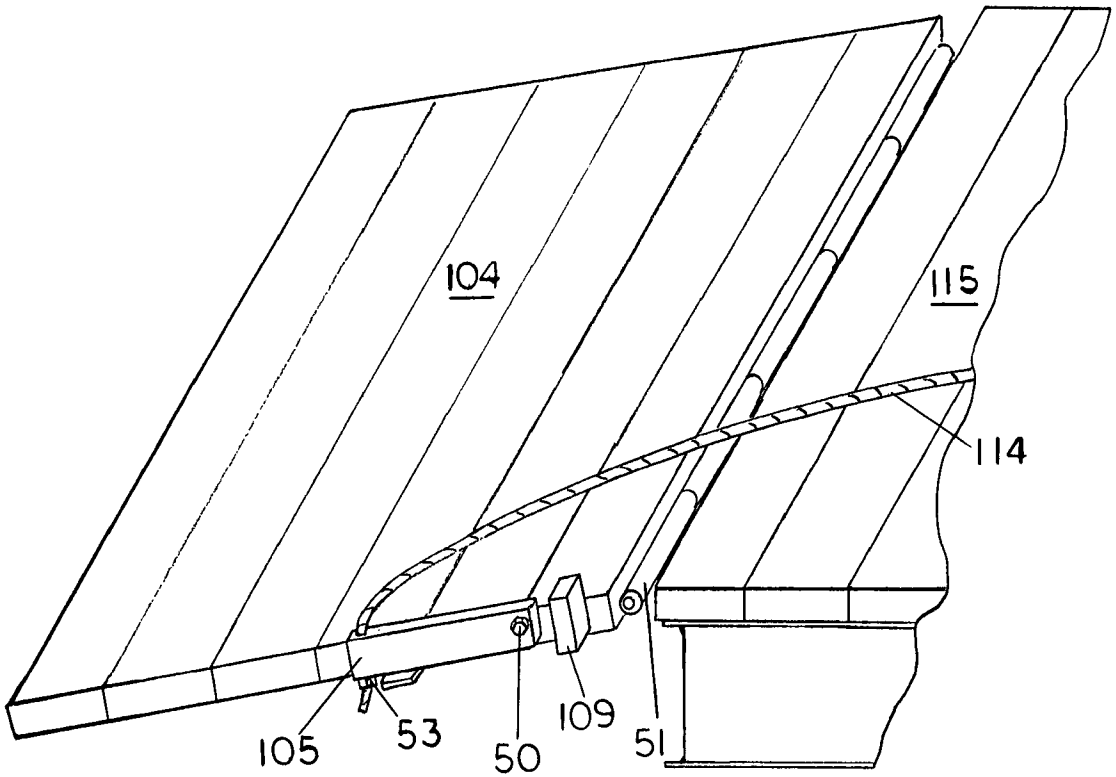
FIG. 9 shows a perspective view of a preferred walkway ramp with a preferred pivot arm and stop.

FIG. 9 shows a perspective view of a walkway ramp 104 and a section of a walkway 115. Walkway ramp 104 is shown attached to walkway 115 by a hinge 51. Walkway ramp 104 has a pivot arm 105 secured by a bolt 50. Pivot arm 105 can be rotated on bolt 50 until pivot arm 105 hits a stop 109. Winch cable 114 is attached to pivot arm 105 with a cable stop 53 near the end of the cable.

FIG. 10 shows a perspective view of a preferred embodiment operator control center 82. Said operator control center 82 comprises of a plurality of switches 93A, 93B, 93C, 93D and a pedestal 83. Said switches are used for controlling the operations of the preferred embodiment invention. Switch 93A and 93D control the operation of the mooring winch mechanisms 40 and 80 shown in FIG. 1, FIGS. 4A and 4B. Switch 93B controls anchor/ramp winch 110 shown in FIG. 1, and switch 93C operates motorized speed reducer 17. Said switches have three positions: center off, back, and forward.

Figure 11:
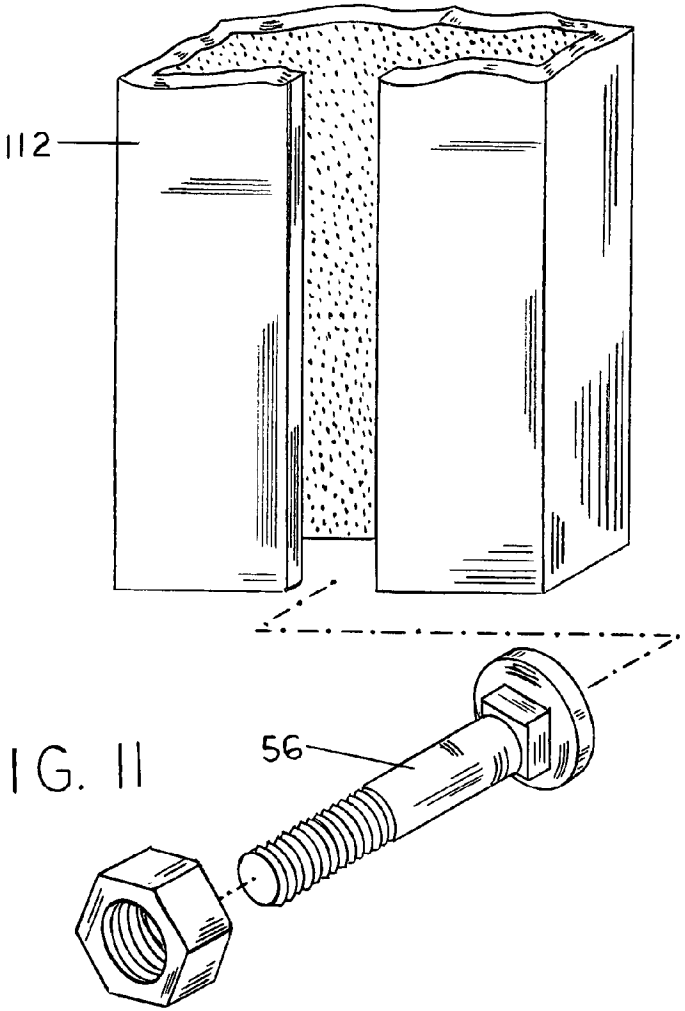
FIG. 11 shows a perspective view of the lower section of a vertical anchor guide which is part of the walkway anchor mechanism shown in FIG. 8.

FIG. 11 shows a perspective view of the lower portion of the vertical anchor guide assembly 112 and bolt and nut 56.

Operation of Preferred Embodiment Invention

In operation, the preferred embodiment invention will function as follows: To relocate the dock mover of this invention toward the main body of water, operator control center 82 shown in FIG. 1 is accessed by an operator and switch 93B shown in FIG. 10 is activated in a back position thereby causing FIG. 1 anchor/ramp winch 110 to take-in winch cable 114, thereby causing pivot arm 105 to rise and stop rotation against stop 109 shown in FIG. 9. Continued motion of anchor/ramp winch 110 will cause FIG. 1 walkway ramp 104 to rise.

FIG. 1 and FIG. 8 reflects that with the same continued anchor/ramp winch 110 rotation as noted previously, primary winch anchor arm 113 will move toward anchor/ramp winch 110. As primary winch anchor arm 113 moves closer to anchor/ramp winch 110, guide bolts and nuts 56 shown in FIG. 8 slide upward within vertical guide 112, thereby causing anchor cross arm 54 to move away from primary winch anchor arm 113. The movement of slide pins 55 sliding apart and guide bolts and nuts 56 sliding upward causes anchor arm 52 and lower anchor arm 59 to retract in an upward manner. At this time walkway ramp 104 in FIG. 1 is lifted off beach area 102 and anchor assembly 106 is retracted.

Next, FIG. 1 anchor cables 90 need to be let out of left mooring winch mechanism 40 and right mooring winch mechanism 80 providing slack in cables 90 so the dock assembly can be moved out. To do this, the operator will activate switch 93A and switch 93D in a forward position in operator control center 82 as show in FIG. 10. Toggle switch 93A powers left mooring winch mechanism 40 and toggle switch 93D powers right mooring winch mechanism 80. FIG. 4A and FIG. 4B reflect cable 90 letting out under roller 43. Cable flows from winch 41 under feed roller 43 into cable feed assembly 44 and through feed rollers 47 and 48 thereby exiting said winch mechanisms 40 and 80. Typically, said mooring winch mechanisms let-out cable into water 111.

Next, the operator will access the operator control center 82 and operate switch 93C shown in FIG. 10 in a back position. Switch 93C powers FIG. 1, FIG. 2, and FIG. 3 motorized speed reducer 17 thereby causing clutch sprocket 30 to turn chain 16. Clutch sprocket 30 automatically engages to power chain 16 to turn sprocket 36. FIG. 2 and FIG. 3 reflect sprocket 36 is secured to master drive hub assembly 21 which is connected to axle 34 by inner axle bolt and nut 26. Slave drive hub 22 is also secured to axle 34 by another inner axle bolt and nut 26. Master drive hub assembly 21 is interconnected to wheel 20A and slave drive hub 22 is interconnected to wheel 20B. Therefore, as motorized speed reducer 17 is powered to rotate by activating switch 93C in a back position, clutch sprocket 30 turns sprocket 36 with chain 16. As sprocket 36 is rotated, so does wheels 20A and 20B. As wheels 20A and 20B rotate, the dock assembly will move toward the main body of water. Disengaging switch 93C will stop the relocation motion at the desired location.

Upon reaching the new desired position, the operator would now lower FIG. 1 walkway ramp 104 by activating FIG. 10 switch 93B in a forward position in the operator control center 82 of FIG. 1. This action would let-out winch cable 114 in anchor assembly 106 causing walkway ramp 104 to lower and contact beach area 102. Anchor assembly 106 will extend downward and into beach area 102. With slack in winch cable 114, spring 107 shown in FIG. 1 and FIG. 8 maintains a constant downward pressure of anchor assembly 106 thereby providing a secure anchor for the end of walkway 115.

The final step would be to take-up slack in cables 90 of FIG. 1. This is done by reversing the action of the left mooring winch mechanism 40 and right mooring winch mechanism 80 with FIG. 8 switches 93A and 93D in the operator control center 82 by activating said switches in a back position. Upon cables 90 tightened in FIG. 1 the dock assembly shown in FIG. 1 is secure.

To relocate the floating dock mover of this invention toward the water shoreline 103 and away from the main body of water 111, one would first raise walkway ramp 104 and anchor assembly 106 shown in FIG. 1. This would involve operating FIG. 1 operator control center 82, FIG. 10 switch 93B in a back position. Walkway ramp 104 will rise when activating anchor/ramp winch 110. This winch action causes winch cable 114 to tighten and rotate pivot arm 105 against stop 109 shown in FIG. 9. This same anchor/ramp winch 110 action would cause FIG. 1 anchor assembly 106 to retract and no longer be in contact with beach area 102. FIG. 8 reflects that taking up winch cable 114 will cause primary winch anchor arm 113 to move toward anchor/ramp winch 110. Also, guide bolts and nuts 56 would retract and anchor cross arm 54 would move away from primary winch anchor arm 13. Slide pins 55 will move in an opposite direction within the track of anchor frame 108. Spring 107 would expand. This process will cause lower anchor arm 57 to rise. This process will now have walkway ramp 104 raised and anchor assembly 106 retracted.

Next, the process will be to tighten cables 90 by activating switches in FIG. 1 operator control center 82. Switches 93A and 93D in FIG. 10 are activated in a back position to tightened cables 90 in FIG. 1 in left mooring winch mechanism 40 and right mooring winch mechanism 80. This winching process pulls the dock assembly toward shore embankment 101. The operator would continue this action until the dock assembly is located in the desired position. Due to the directional slippage operation of clutch sprocket 30 this process causes FIG. 1, FIG. 2, and FIG. 3 live axle wheel assembly 18 to rotate freely and turn as the left and right mooring winch mechanisms 40 and 80 are pulling the dock assembly toward shore embankment 101. Clutch sprocket 30 will engage in one direction and slip in the opposite direction.

Next, switch 93B shown in FIG. 10 would be pressed in the forward position-causing walkway ramp 104 in FIG. 1 to contact the ground and anchor assembly 106 to retract and rod 59 to be forced into beach area 102 by the contracting spring pressure of spring 107, thereby providing an anchor.

Thus the reader will see this invention, a floating dock mover does provide an easy to use, efficient, and desirable means to relocate a dock both horizontally and vertically in relation to a moving shoreline as water level changes.

While my above description contains many specificities, these should not be constructed as limitations on the scope of the invention, but rather as an exemplification of one preferred embodiment thereof. Many other variations are possible. Examples are as follows:

- The electrical power source may be AC or DC voltage. It may also be powered by solar power.
- The scissor anchor may be replaced with commonly found vertical electrical powered lift(s) or jack mechanisms that would provide anchoring characteristics.
- Many variations are possible for a configuration of motorized winch mechanisms.
- Numerous other common configurations for an electrically powered live axle wheel assembly are possible as long as both wheels are made to turn when an electrical power source is activated.
- There are many possible configurations of the operator control center and electrical control enclosure. Also, switch configurations may be toggle, push button, rotating, or rocker.
- The walkway ramp lifting mechanism shown is just one of many possibilities. Numerous other methods are available to get the ramp lifted utilizing a similar leverage principal.
- The clutch sprocket may be substituted with a typical non-clutch sprocket which would power the live axle in both directions.
- Feed rollers on the anchor/ramp winch assemblies may be replaced with commonly found winch fairleads.

The invention claimed is:

1. A system for maintaining a floating dock at a relative constant position in relation to a moving shoreline on a moving shoreline on a body of water, comprising:

at least one electrically powered winch mechanism with cables attaching the floating dock to the shoreline, which allows the floating dock to be repositioned in relation to the shoreline, wherein the winch mechanism can be let-out or taken-in to obtain desired cable length to change the location or maintain a desired relative position to the shoreline;

an electrically powered live axle with wheels that repositions the a dock walkway and the floating dock relative to the shoreline; and a walkway ramp having a pivot arm disposed at one end; and an anchor assembly, the anchor assembly comprises:

an electrically powered anchor/ramp winch attached to an anchor frame, and a retractable anchor attached to the anchor frame.

2. The system of claim 1, wherein upon operation of the anchor/ramp winch, the retractable anchor arm and the walkway ramp are simultaneously raised or lowered by a cable connecting the anchor/ramp winch to the walkway ramp.

3. The system of claim 2, wherein the cable connecting the anchor/ramp winch and the walkway ramp is secured to a primary arm of the retractable anchor so as to cause lowering and raising of the retractable anchor upon activation of the anchor/ramp winch.

4. The system of claim 1, wherein the anchor is a scissor type anchor.

5. The system of claim 1, where in the anchor is a vertical jack.

6. An electrically powered floating dock mover comprising:

at least one electrically powered winch mechanism securing a floating dock to an anchor point on a shoreline;

an electrically powered anchor mechanism that provides a temporary anchor point at a current location of the floating dock, wherein the electrically powered anchor is retractable so as to remove the temporary anchor point, thereby allowing the floating dock to be repositioned in a new position in a new location;

an electrically powered live axle with wheels; and a one-way electrically powered drive mechanism attached to the live axle that operates to move the floating dock in a position relative to the shoreline.

7. The dock mover of claim 6, wherein the drive mechanism further includes a motorized powered speed reducer for adjusting the movement speed of the dock as it is repositioned by the dock mover.

8. The system of claim 1, further comprising:

a one-way electrically powered drive mechanism to move the floating dock mover in a position relative to the shoreline.

* * * * *